US007884293B2

(12) United States Patent
Ulomek

(10) Patent No.: US 7,884,293 B2
(45) Date of Patent: Feb. 8, 2011

(54) CONTROL FOR THE ELECTRICAL ACTUATION OF A LOCK ON A LID OR ON A DOOR IN A VEHICLE

(75) Inventor: Peter Ulomek, Radevormwald (DE)

(73) Assignee: Huf Hulsbeck & Furst GmbH & Co. KG, Velbert (DE)

( * ) Notice: Subject to any disclaimer, the term of this patent is extended or adjusted under 35 U.S.C. 154(b) by 173 days.

(21) Appl. No.: 12/227,539

(22) PCT Filed: Mar. 22, 2007

(86) PCT No.: PCT/EP2007/002526

§ 371 (c)(1),
(2), (4) Date: Nov. 20, 2008

(87) PCT Pub. No.: WO2007/134663

PCT Pub. Date: Nov. 29, 2007

(65) Prior Publication Data

US 2009/0090143 A1 Apr. 9, 2009

(30) Foreign Application Priority Data

May 24, 2006 (DE) ..... 10 2006 024 292

(51) Int. Cl.
*H01H 3/16* (2006.01)

(52) U.S. Cl. ..... 200/61.76

(58) Field of Classification Search ..... 200/284, 200/343, 406, 61.76
See application file for complete search history.

(56) References Cited

U.S. PATENT DOCUMENTS 3,529,109 A * 9/1970 Cross ..... 200/557
3,691,324 A * 9/1972 Brantingson ..... 200/5 E (Continued)

FOREIGN PATENT DOCUMENTS

DE 198 23 894 1/2000

(Continued)

*Primary Examiner*—Edwin A. Leon
(74) *Attorney, Agent, or Firm*—Lucas & Mercanti, LLP; Klaus P. Stoffel

(57) ABSTRACT

Such a control (10) firstly has a control housing (11) with a control rocker switch (21) which is mounted on the control housing in such a way that it can be rocked and at least two electrical wires in the interior of the housing, which protrude from the control housing (11) and are attached to an electrical drive of one lock. An electrical switch which in turn has a switch housing with a ductile snap disc (40), which interacts with at least two rest contacts as articulated contact when a switch actuator deforms the snap disc, is normally a part of this control. The rest contacts are connected to the wires in the control housing (11). In order to manufacture an economical and space-saving device, it is proposed that the control housing (11) is also used as the switch housing and that the control rocker switch (21) is also utilized as the switch actuator. That way the rest contacts of the switch and the wires are formed from one part in the control housing (21) and make up a grill insert in the control housing (21). The control housing (21) has a support bearing (37) in the area of the grill insert, at which the snap disc (40) is supported with its bearing points.

21 Claims, 9 Drawing Sheets

U.S. PATENT DOCUMENTS

| | | | | | |
|---|---|---|---|---|---|
| 4,343,973 | A | * | 8/1982 | Main | 200/516 |
| 4,438,304 | A | | 3/1984 | Kennedy | |
| 4,739,127 | A | * | 4/1988 | Higuchi et al. | 200/5 R |
| 4,760,221 | A | * | 7/1988 | Yoshida et al. | 200/408 |
| 4,837,411 | A | | 6/1989 | Best | |
| 5,982,269 | A | | 11/1999 | Sorenson | |

FOREIGN PATENT DOCUMENTS

| | | |
|---|---|---|
| DE | 102 02 371 | 8/2003 |
| DE | 102 41 220 | 10/2003 |
| DE | 102 49 579 | 5/2004 |
| DE | 102004040395 | 3/2005 |
| JP | 05 041141 | 2/1993 |

* cited by examiner

CONTROL FOR THE ELECTRICAL ACTUATION OF A LOCK ON A LID OR ON A DOOR IN A VEHICLE

BACKGROUND OF THE INVENTION

The invention concerns a control of the type specified in the introductory clause of Claim 1, as described in DE 102 02 371 B4.

In the previously known control disclosed by DE 102 02 371 B4, the control housing is equipped with a manually operated control rocker, which is rotatably supported in the control housing. A microswitch is located inside the control housing. The microswitch has a housing with a deformable snap disk, which produces a moving contact in the microswitch. At least two rest contacts are then provided in the switch housing, which are connected with the lines in the control housing. The control rocker acts on a switch actuator in the microswitch, thereby deforming the snap disk. In its rest position, the snap disk assumes a shape that is arched on one side. The switch actuator causes the snap disk to deform and move into a flat position or a position with the disk arched in the opposite direction. As a result, the microswitch moves from a noncontacting rest position into a contacting operating position. This control has numerous individual parts that take up a great deal of space.

DE 102 41 220 C1 discloses a snap disk, which can generate not only the digital signal according to the aforesaid rest position and operating position but also an analog signal. To this end, a cup-shaped region with two surfaces on the snap disk is proposed.

DE 198 23 894 C1 discloses an arched snap disk with at least two bearing points for a support bearing. At least one of the support elements is used as a fastening element for the snap disk. For this purpose, the fastening element is joined by webs with one of the bearing points.

DE 10 2004 040 395 A1 discloses an electric pushbutton switch, which has an arched snap disk in the switch housing below a pressure surface. The switch housing comprises a base, on which the push button is supported via an elastic bellows. The bellows is embraced by a cover with a hole, from which the push button projects. The cover has attachments, which support the base from below after the housing has been assembled. A control with a control rocker is not provided here.

U.S. Pat. No. 4,438,304 discloses an electric pushbutton switch, which likewise has an arched snap disk in a switch housing. The switch housing is closed by an overlying plate, by which a mechanical actuating element acts on the snap disk and thus triggers the switch. However, a disadvantage of this type of pushbutton switch is that the housing is unprotected from dust and liquid due to the overlying plate.

JP 5[1993]-041,141 discloses an electric pushbutton switch, which combines two snap disks in a switch housing, such that the snap disks are jointly actuated by a pushbutton switch cap. This switch is also not protected from the penetration of liquids and dust. Only the actuating element is put in place in such a way that it covers the base. However, since the actuating element must be operated and in the rest position stays in the unoperated state, it does not seal the base and does not provide protection against the penetration of dust and moisture.

U.S. Pat. No. 4,837,411 discloses an electric pushbutton switch composed of a base and an operating member. In this patent, a rocker function is provided, where the operating member has an oblong design and can be operated on both sides, so that two different pushbutton functions are realized.

Here again, however, the device fails to provide protection against the penetration of dust and moisture.

SUMMARY OF THE INVENTION

The objective of the invention is to develop a compact, inexpensive control of the type specified in the introductory clause of Claim 1. This is achieved by the measures listed in Claim 1, which have the following special significance.

In the invention, the control housing directly has the function of a switch housing, because it directly possesses the support bearing for bearing points of the snap disk. The control rocker then acts at the same time as a switch actuator. The invention then proposes to form the rest contacts of the switch and the electric lines in the control housing as a single piece and to mount them as insert grids inside the housing. Linear strands, which are possibly bent at an angle, are adequate for the insert grid to function as rest contacts beneath the snap disk. The outer end sections of these linear, current-carrying strands then serve as land contacts for electrical couplings to be connected to the control housing. After production of the control housing with integrated insert grid, it is then only necessary to mount the snap disk on the support bearing and then to set the control rocker on the control housing. There are only a few parts that are easy to handle and can be assembled quickly and compactly.

Additional measures and advantages of the invention are specified in the dependent claims and the description which follows and are illustrated in the drawings, which show several embodiments of the invention.

DETAILED DESCRIPTION OF THE INVENTION

Figure 1A:
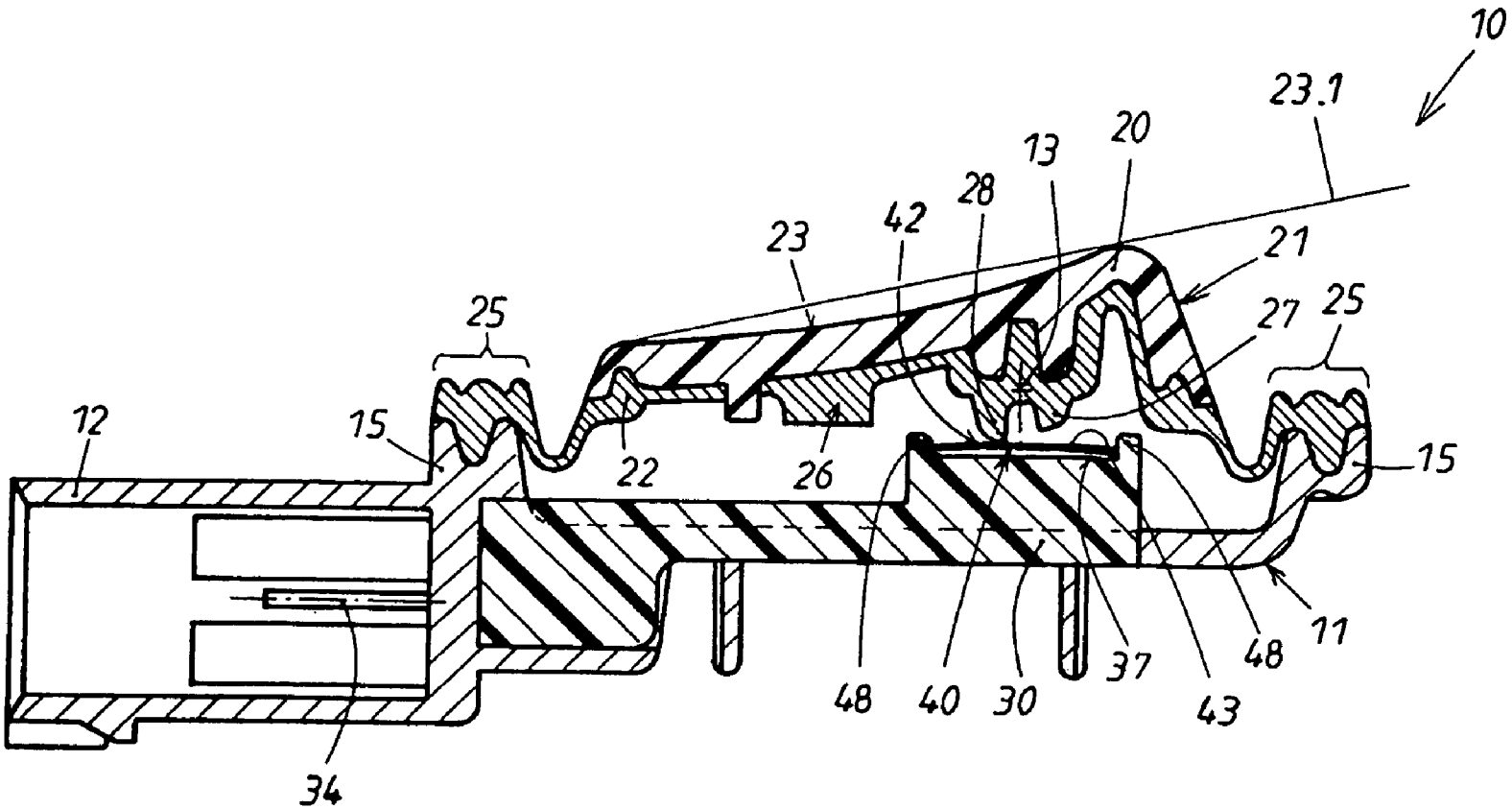
FIG. 1*a* shows a cross section through the control of the invention when the control rocker is in its rest position.
Figure 1B:
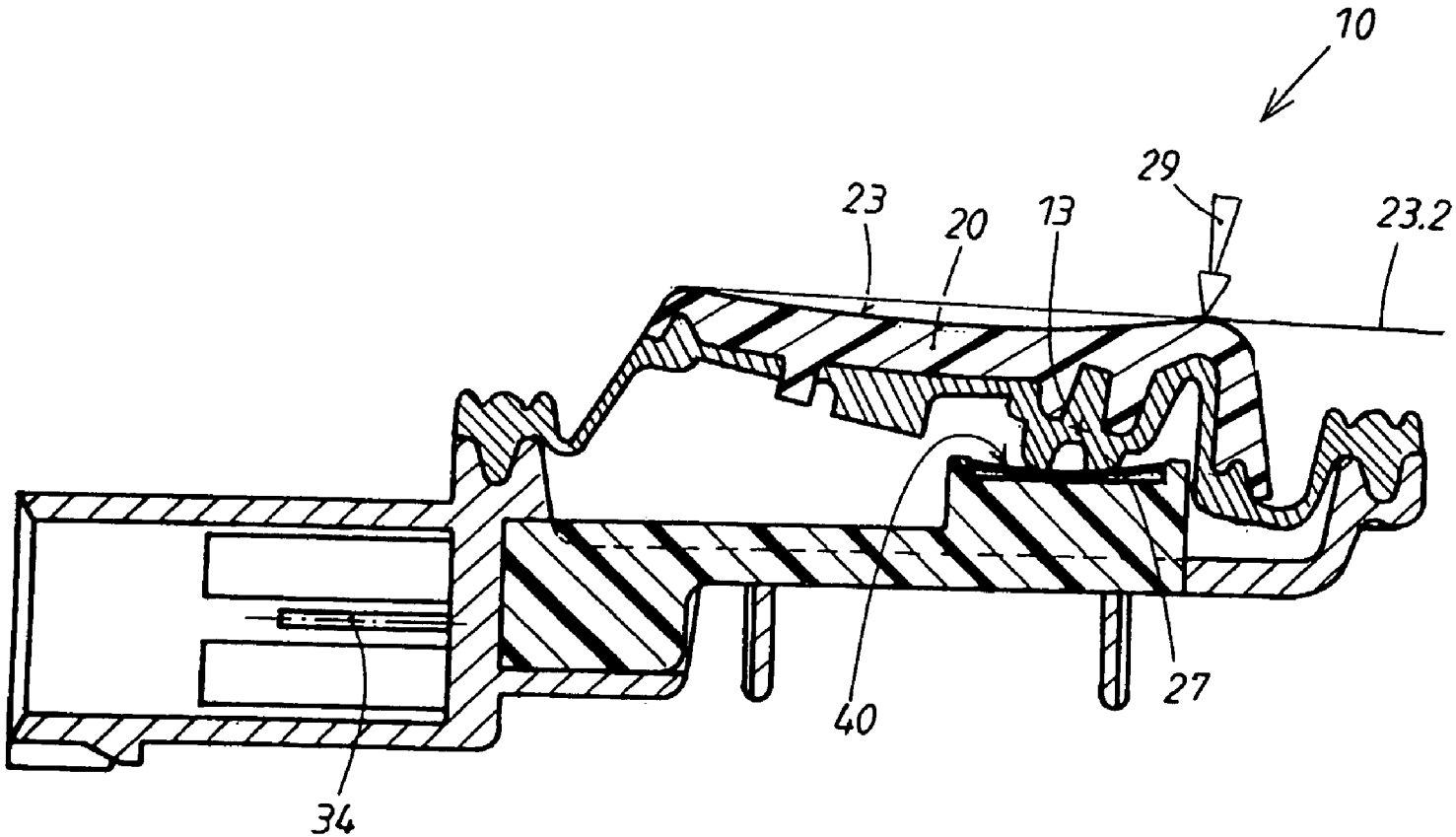
FIG. 1*b* shows the same cross section through the control after the control rocker has been moved into its contacting operating position.

The control 10 shown in FIGS. 1*a* and 1*b* is mounted in the area of a trunk lid or hatch of a motor vehicle and is used for opening the trunk lid or hatch. The control 10 is used for electric actuation of a lock, which operates between the trunk lid or hatch and the body of the vehicle. The control 10 consists of a shell-like lower control housing 11 and a control rocker 21, which serves as a cover for the shell 11.

Figure 5:
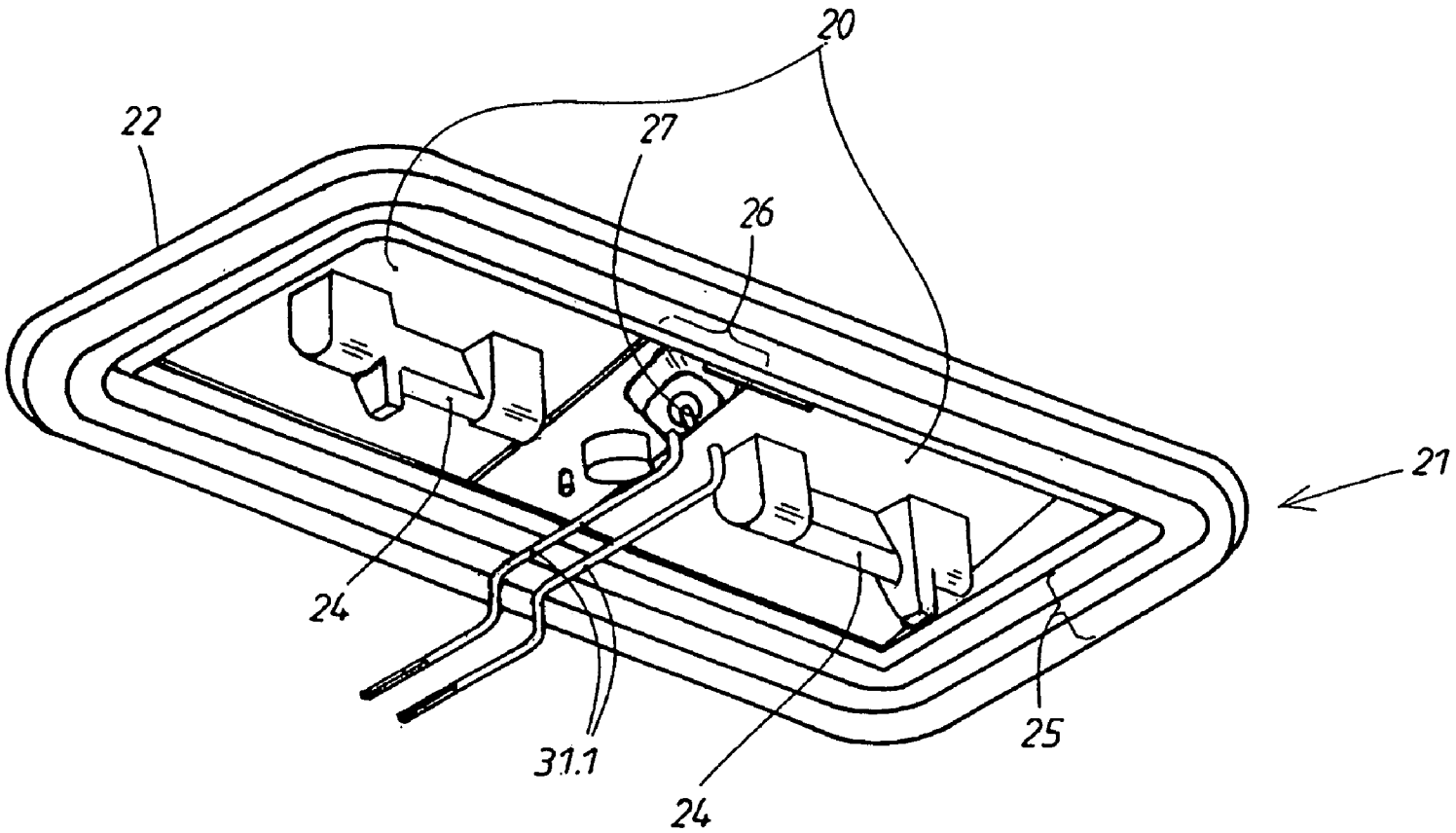
FIG. 5 shows a perspective rear view of the associated control rocker for the control housing of FIG. 2, wherein the position of the stamped grid according to FIG. 4 is illustrated in its mounted state.

As FIG. 5 shows, the control rocker 21 is produced by a so-called multicomponent injection molding technique. It consists of a hard component 20, which forms both the central area 23, which is seen in FIG. 1*a* and serves as a manual handle, and the swivel bearing parts 24 in the rear side of the control rocker 21, as shown in FIG. 5. The swivel bearing parts 24 comprise two bearing blocks that project from the underside. The other component of the injection molded control rocker 21 is a soft component 22, which forms a peripheral elastomeric edge region 25, as shown in FIGS. 1*a* and 5. In addition, in a central strip 26, this soft component 22 controls the underside of the central area 23 and also forms from this material a special actuating striker on the underside of the control rocker 21, as shown in FIGS. 1*a* and 5.

The edge region 25 formed from the soft component 22 surrounds the central area 23 on the frame side. During the assembly of the control 10, the elastomeric frame is placed on a peripheral shell edge 15 of the control housing 11 shown in FIG. 2 and welded with it. The welding can be carried out especially by laser welding. For this purpose, as FIG. 1*a* shows, the edge region 25 of the control rocker 21 and the shell edge 15 of the control housing 11 have wave-like labyrinthine profiles that complement each other.

The interior 55 of the control housing 11 has two cooperating swivel bearing parts 14, which engage the swivel bearing parts 24 of the control rocker 21 during the aforesaid assembly. In the present case, these cooperating bearing parts 14 consist of two bearing shells, which receive a web on the aforesaid bearing block 24 of the swivel bearing parts 24.

Figure 2:
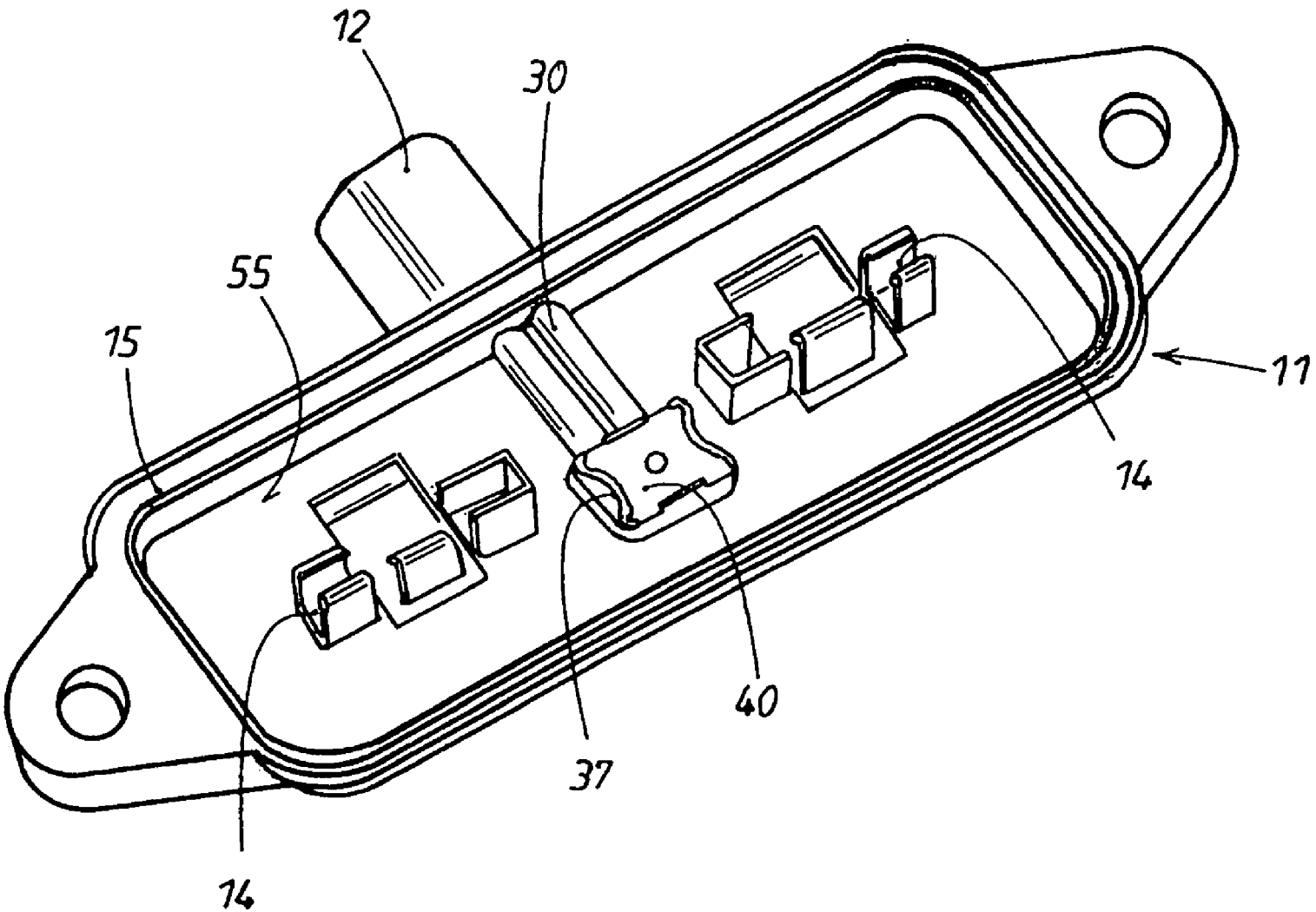
FIG. 2 shows a perspective view of the shell-like control housing with its internals before it is connected with the control rocker, which functions as a cover.

As FIG. 2 shows, a combined insert 30 is integrated in the housing interior 12. One of the components of the combined insert 30 is an insert grid 31.1 that consists of two linear metal conductors 32.1, 33.1, which can be bent at an angle. The two conductors 32.1, 33.1 are precoated with an electrically insulating compound, e.g., by extrusion coating. The resulting structure 50 has alternate thick and thin hatching in FIG. 1*a*. In particular, the prefabricated combined insert 30 is correctly positioned in an injection mold, in which the control housing 11 is then produced. In the finished product, rear end sections 34 of the insert grid 31.1 then extend from the control housing 11, as FIG. 1*a* shows. In the vicinity of these rear end sections 34, a sleeve 12 is also formed from the housing material. This sleeve 12, in conjunction with the rear end sections 34, then has the function of an electric plug. Front end sections 35.1, 36.1 of the two conductors 32.1, 33.1 are located at the other end. They cooperate with a snap disk 40 in a way that will be described in detail below.

As seen in a top view, the snap disk 40 has the shape of a four-pointed star, whose four points serve as bearing points 41. The snap disk 40 is provided with an arch 43, which is curved convexly towards the upper side 42 of the disk. This convex arch 43 is indicated by a dot-dash line in FIG. 4 and can also be seen in FIG. 1. A small dent 44 may be formed in the center of the convex arch 43, which contributes to the stability of the arch 43 in the rest position. The bearing points 41 located at the points of the star are joined with each other by a curved disk edge 45. This gives rise to the star-like structure with the four bearing points 41.

Figure 4:
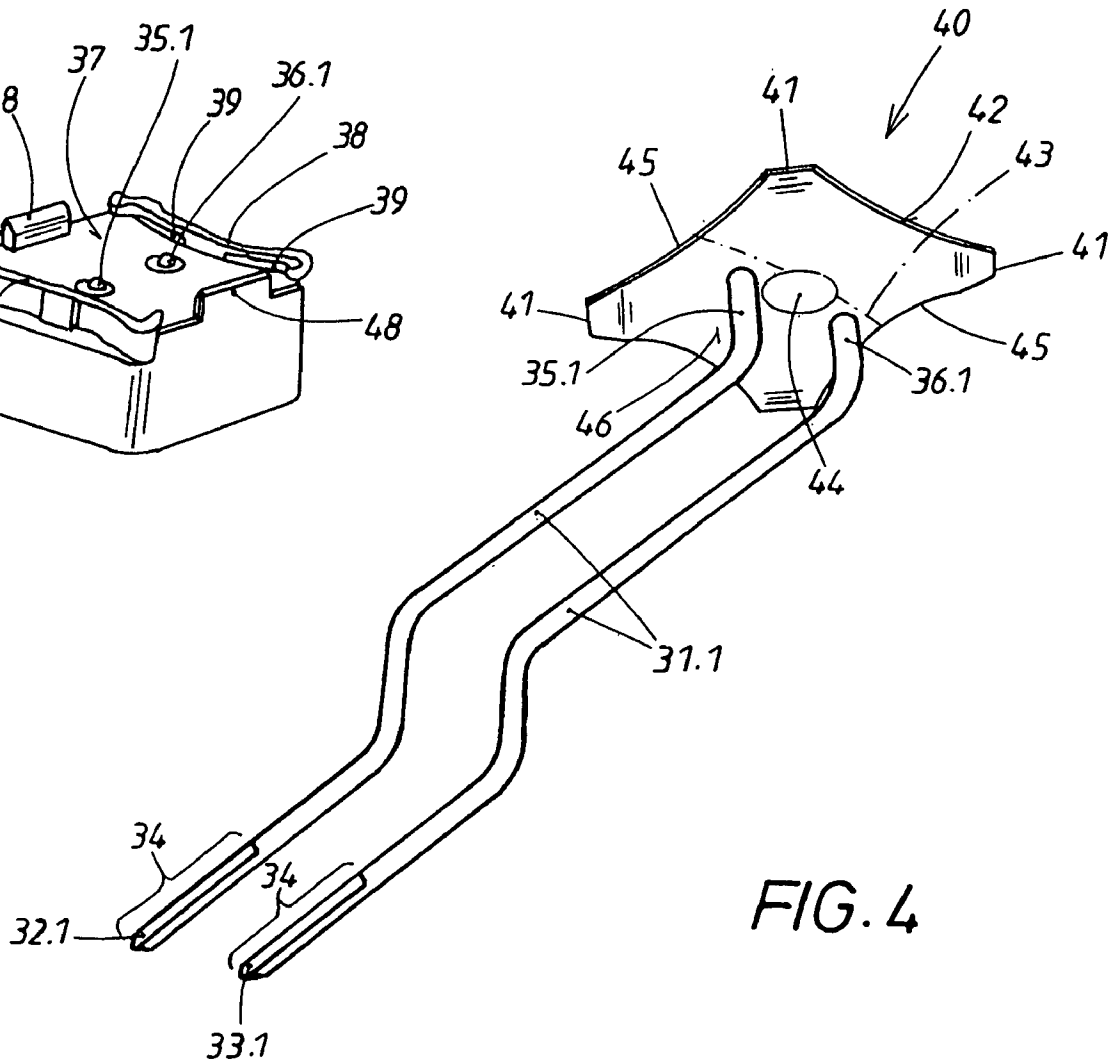
FIG. 4 shows a first stamped grid, which is located inside the combined insert of FIG. 3, so that when actuation occurs, it can cooperate with a snap disk that can already be seen in FIG. 2.
Figure 3:
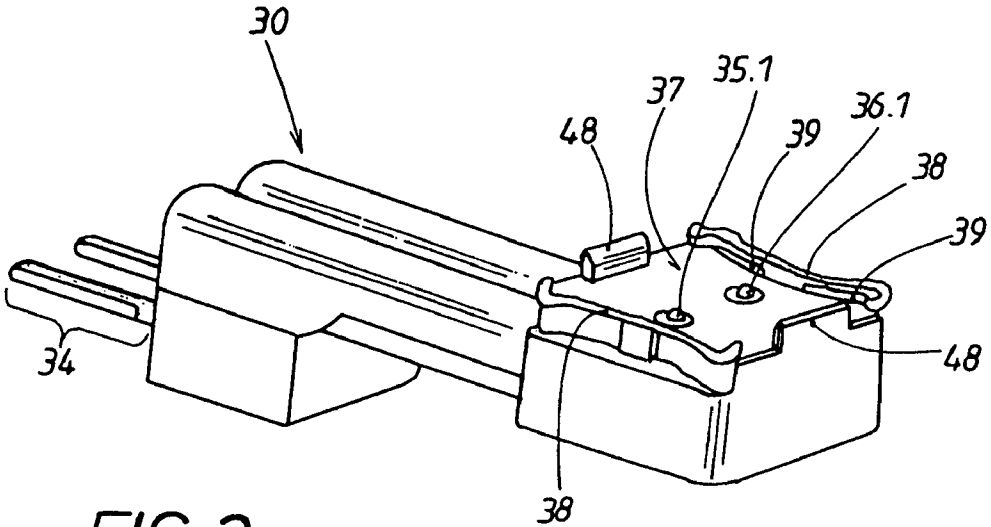
FIG. 3 shows a combined insert of FIG. 2 to be placed in the housing interior during the production of the control housing by injection molding.

At the inner end of the combined insert 30, there is a flat support bearing 37 for the snap disk 40. Two clips 38 are located on opposite sides of the support bearing 37. Each clip 38 has two openings 39 for receiving the tapering bearing points 41 of the snap disk 40. At the two other opposite locations of the support bearing 37, guide elements 48 can be provided, such as the webs 48 shown in FIG. 3. These webs 48 guide the snap disk as it is being placed on the base of the support bearing 37. As FIG. 3 shows, the end faces of the two front end sections 35.1, 36.1 of the conductors also open in the base of the support bearing 37. They lie bare opposite the concavely arched underside 46 of the snap disk 40, as shown in FIG. 4.

After completion of the assembly consisting of the control housing 11 and the combined insert 30, as mentioned above, it only remains to place the prefabricated snap disk 40 on the support bearing 37. The control rocker 21 is then joined with it in the manner that has already been described, as shown in FIG. 1*a*. It should be noted that in the rest position illustrated in FIG. 1*a*, the actuating striker 27 does not exert pressure on the convex arch 43 of the snap disk 40. However, as FIG. 1*a* shows, the actuating striker 27 can have a profile piece 28 that serves to secure the position of the unactuated snap disk 40 on the base 37 on the housing side. The profile piece 28 ensures that the snap disk cannot fall off the support bearing 37. The elastomeric soft component 22 of the control rocker 21 ensures that the unactuated handle 23 is normally held in an "off" position of the control 11, which is illustrated by the auxiliary line 23.1 in FIG. 1*a*. In this unactuated position of the handle 23, the snap disk 40 is then positioned in its noncontacting rest position relative to the insert grid 31.1.

FIG. 1*a* indicates the position of a swivel bearing 13 between the control rocker 21 and the control housing 11, which results from the described engagement position between the swivel bearing part 24 on the control side and the cooperating swivel bearing part 14 on the housing side. If the handle 23 is operated in the direction of the force arrow 29 in FIG. 1*b*, it causes deformation of the elastomeric material 22, which, as noted earlier, normally works to hold the handle 23 in its "off" position 23.1, as shown in FIG. 1*a*. The actuation 29 causes the handle 23 to move into its other position, in which its actuating striker 27 deforms the snap disk 40. This actuated switching position is indicated by the auxiliary line 23.2 in FIG. 1*b*. The convexity 43 of the disk, which was described earlier and is shown in FIG. 1*a*, becomes flattened, or the disk may now even be convex in the opposite direction. With respect to FIG. 4, this means that the snap disk 40, which consists of electrically conducive material, short-circuits the front end sections 35.1, 36.1 of the insert grid 31.1 in FIG. 4. The aforesaid position 23.2 of FIG. 1*b* is thus the "on" position, in which an electric circuit is closed with respect to the actuator of the lock (not shown).

Figure 7:
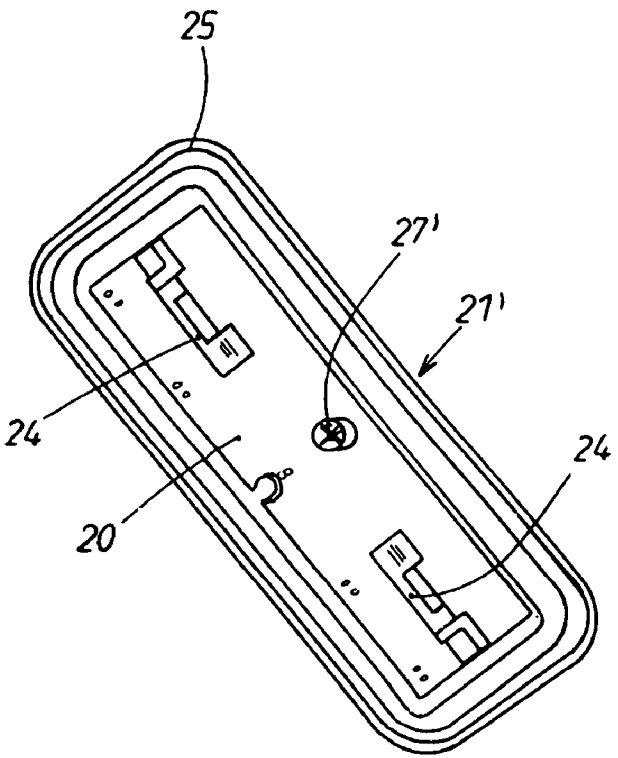
FIG. 7 shows the rear view of a control rocker for the control housing of FIG. 6.
Figure 6:
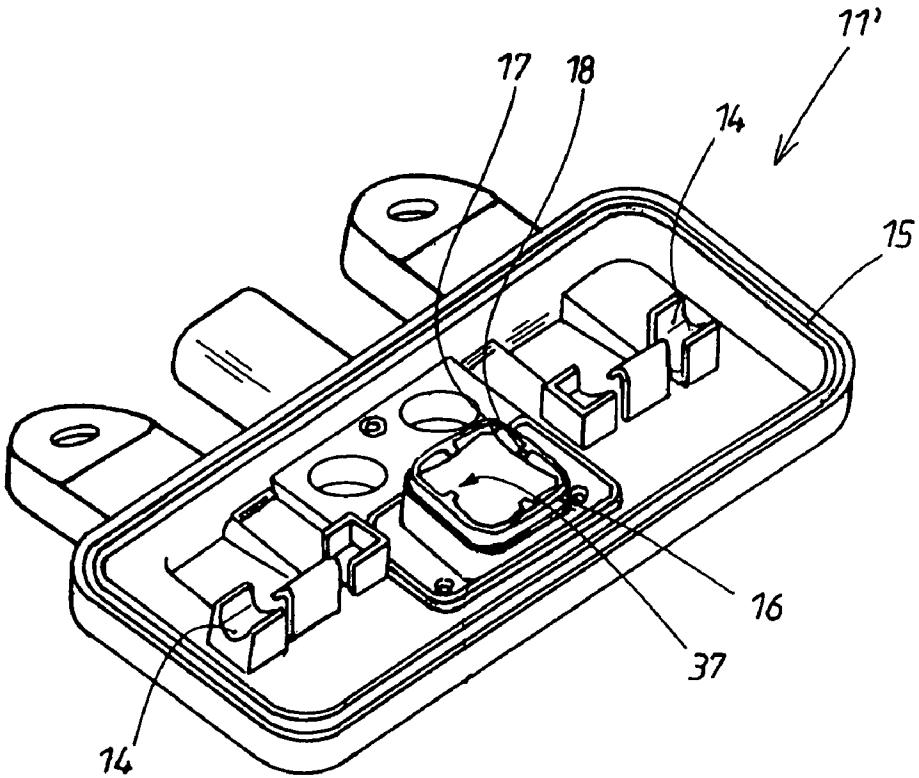
FIG. 6 shows a second embodiment of a control housing in a perspective view analogous to FIG. 2.

FIGS. 6 and 7 show an alternative design of a control housing 11' and a control rocker 21'. In this case, a stamped grid (not shown here) is integrated in an electric component carrier 16, which serves as an insert in the housing mold during the injection molding of the shell-like control housing 11'. At its inner end, the electric component carrier 16 has a shell-like receptacle 17, which is used for the insertion of a snap disk 40. This receptacle 17 also has locking means or positioning webs 18 for ensuring that the snap disk 40 is properly seated after it has been inserted.

In the housing 11', the cooperating swivel bearing parts 14 are positioned basically in the middle with respect to the broad dimension of the control housing 11', which serves to realize a central position of the swivel bearing 13 described in connection with FIGS. 1*a* and 1*b*. This results from the fact that the associated control rocker 21' of FIG. 7 also has a central arrangement of its swivel bearing parts 24. In this case, the hard component 20 occupies the entire central area on the underside of the control rocker 21' and then also forms the actuating striker 27' there. The control housing 11' is produced with the control rocker 21' by laser welding between the frame-like rocker edge region 25 and the shell edge 15 of the control housing 11'.

Figure 8B:
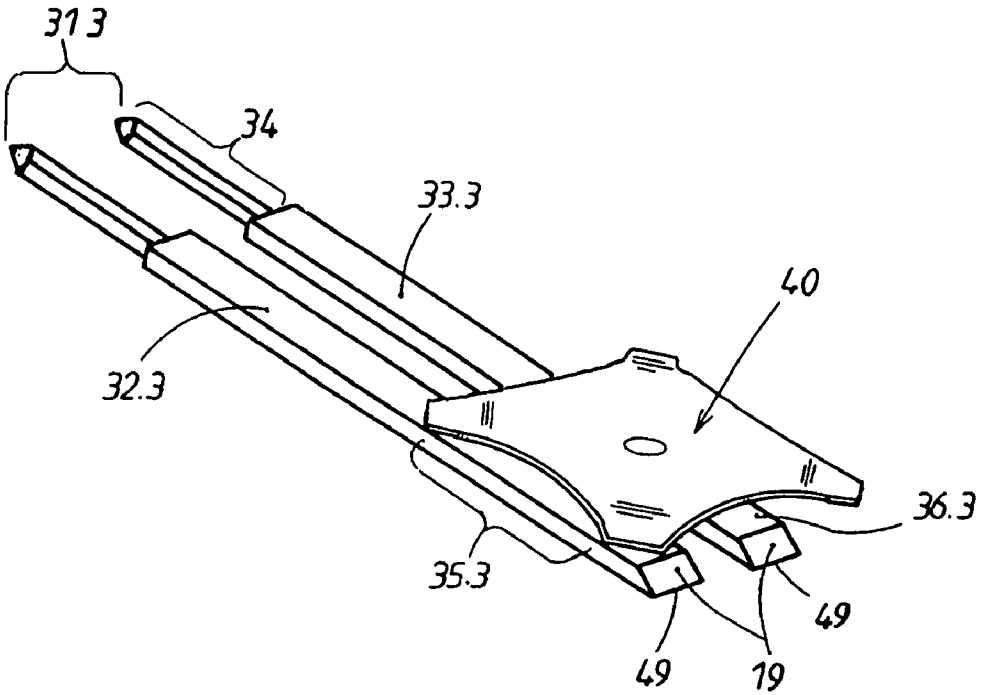
FIGS. 8*a* and 8*b* show two different designs for an insert grid in the control housing, which is inserted in the housing interior before or after the production of the control housing by injection molding and cooperates with a snap disk.
Figure 8A:
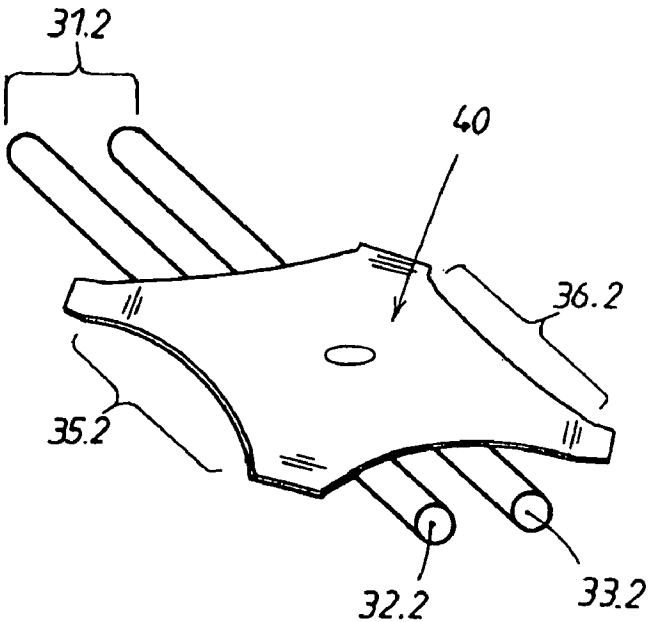

FIG. 8*a* shows a second embodiment of an insert grid 32.2, which consists of two grid rods 32.2 and 33.2. After the control housing (not shown here) has been produced, the grid rods 32.2, 33.2 are inserted in well-defined locations inside the housing. This can be accomplished by pushing them through the wall of the housing, which can also be suitably weakened in these well-defined places. In the process, the associated front end sections 35.2, 36.2 arrive in a region of the housing in which the support bearing for the bearing points of the snap disk 40, which is only indicated in FIG. 8*a*, is located. The two grid rods 32.2, 33.2 have, e.g., a circular cross section, as shown in FIG. 8*a*.

In a view that is analogous to FIG. 8*a*, FIG. 8*b* shows an alternative design of an insert grid 31.3 of this type. It is sufficient here merely to discuss the differences between this design and the design of FIG. 8*a*.

One difference is that the two grid rods 32.3, 33.3 have a flat cross section, e.g., a rectangular cross section. Another difference is that the associated front end sections 35.3, 36.3 have profilings 19 at the ends of the rods. In the present case, these profilings consist of a cutting edge 49, which clears its own path through the wall of the housing when the grid rods 32.3, 33.3 are pressed into the associated control housing during their assembly. The grid rods 32.3, 33.3 are elongated like the blade of a dagger. Naturally, instead of a subsequent insertion movement, the grid rods 32.2 to 33.3 could also be placed as an insert into the mold that is used for the injection molding of the control housing.

Figure 9B:
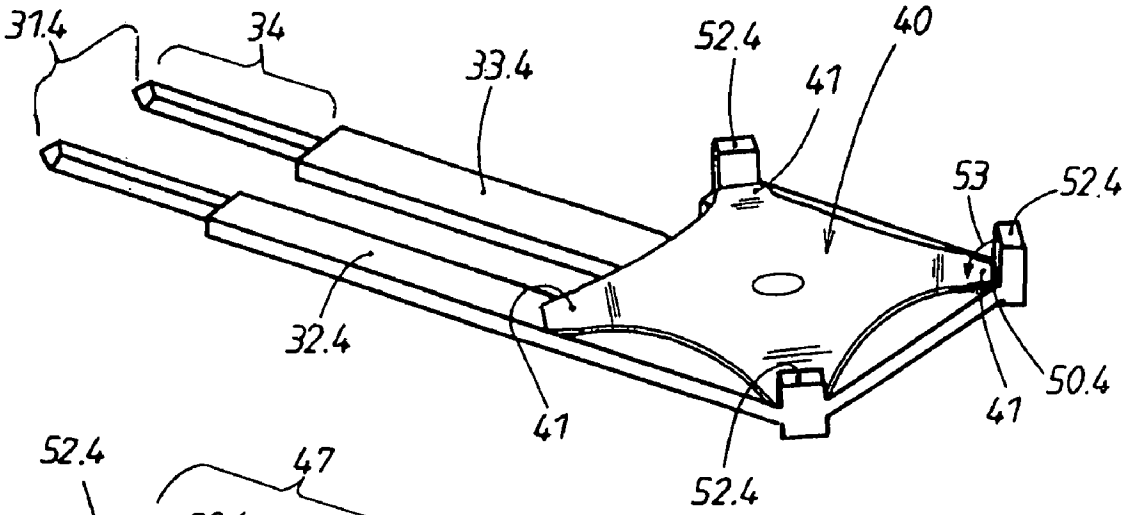
FIG. 9*b* shows the insert grid illustrated in FIG. 9*a* after a snap disk has been put in place.
Figure 9A:
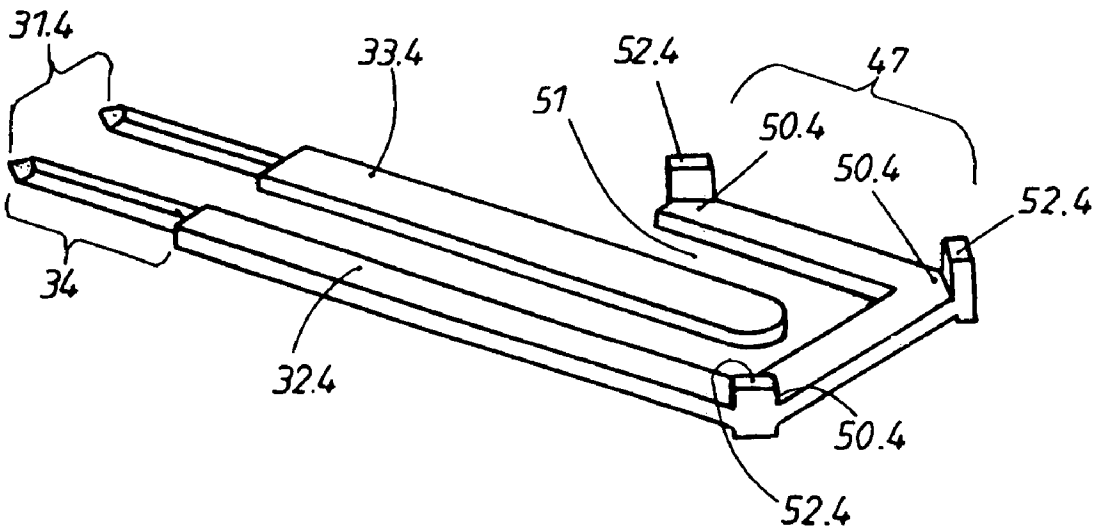
FIG. 9*a* shows a perspective view of another embodiment of an insert grid without a snap disk.

FIG. 9*a* shows another embodiment of an insert grid 31.4. One of the grid rods 32.4 has an inner section 47, which is wound into a more or less U-shaped structure and forms four support bearings 50.4 for the four bearing points 41 of the snap disk 40, which are shown in FIG. 9*b*. The other grid rod 33.4 extends into the winding interior 51 of the inner section 47 and supports the snap disk 40 from below in its arched region, as shown in FIG. 5*b*. The wound inner section 47 has upwardly projecting tongues 52.4 in the corner regions of its winding. When the snap disk 40 is being put in place, these tongues 52.4 serve first to guide its tapering bearing points 41, as shown in FIG. 9*b*. However, the tongues 52.4 then also serve to secure the position of the snap disk 40, because they can be bent over the disk bearing points 41, as indicated by the bending arrow 53 in FIG. 9*b*. The position of the snap disk 40, secured by the bent tongues 52.4, is then fixed on the insert grid 31.4 on the inside of the control housing (not shown here). The rear end sections 34 of the two grid rods 32.4, 33.4 that extend from the housing can be recessed, as shown in FIGS. 9*a*, 9*b*.

Figure 10:
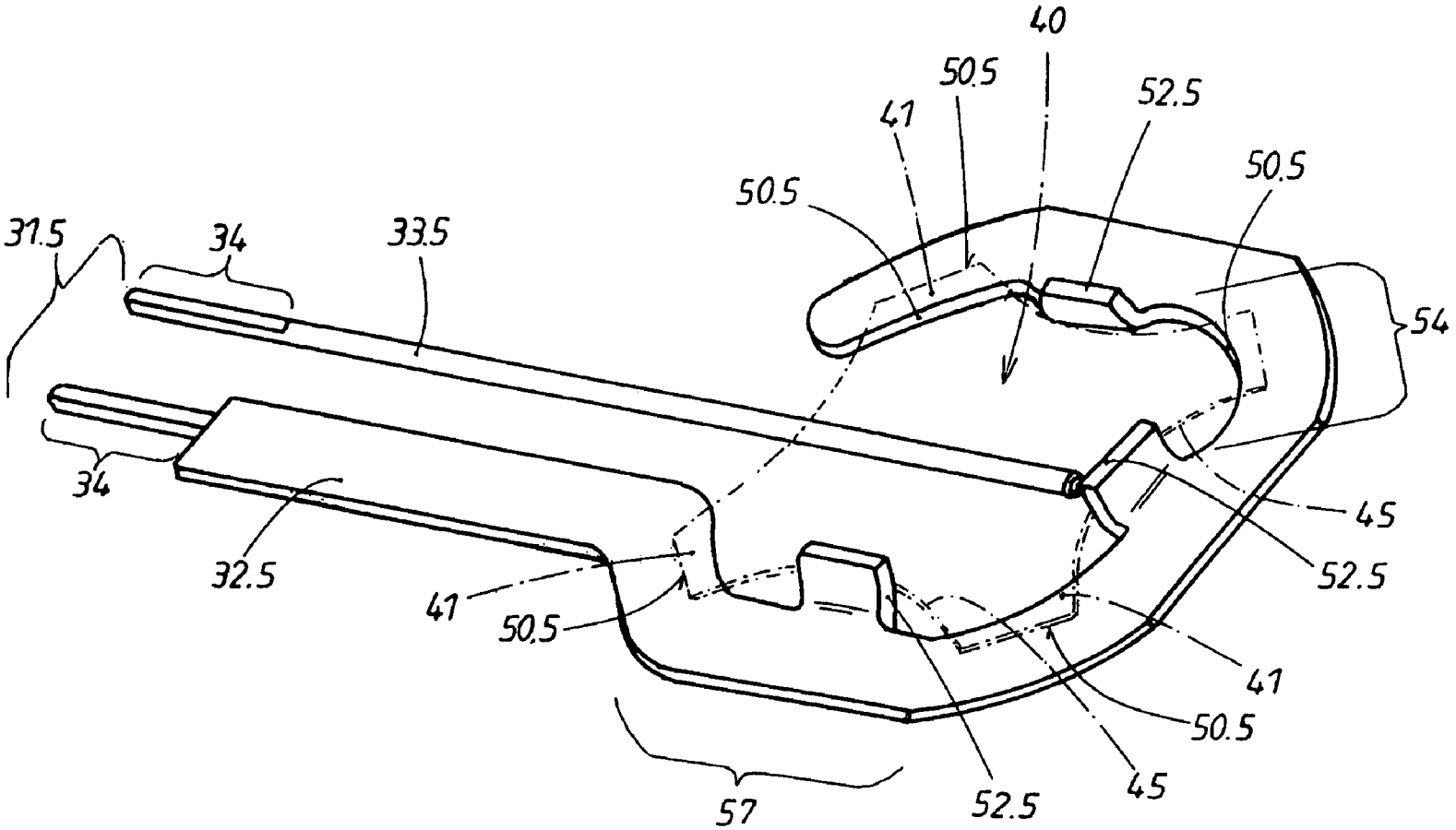
FIG. 10 shows another embodiment of an insert grid with a snap disk that cooperates with it in a view analogous to FIG. 9*b*.

FIG. 10 shows an insert grid 31.5 similar to the insert grid of FIGS. 9*a*, 9*b*, and to this extent the description of the preceding embodiment also applies here. It will be sufficient merely to discuss the differences.

One of the grid rods 32.5 of the insert grid 31.5 likewise has a flat profile, while the other grid rod 33.5 has a circular cross section. The two rear end sections 34 of the two grid rods 32.5, 33.5, which are part of a future electric plug on the control housing, are recessed into the same shape and have an almost square cross section. The grid rod 32.5 with the flat profile has a flat inner section 57 that is bent at an angle and wound into the shape of an octagon. Upwardly projecting tongues 52.4 are again present on three of the octagonal sides of the inner section 57. Four support bearings 50.5 for the tapering bearing points 41 of a snap disk 40, which is illustrated with dot-dash lines in FIG. 10, lie in the gaps 54 between the tongues 52.4. For this reason, the tongues 52.4 do not act at the bearing points 4 but rather in the arched region at three of the four curved disk edges 45 of the snap disk 40.

LIST OF REFERENCE NUMBERS

10 control of the invention
11 control housing, shell
11' control housing, shell (FIG. 6)
12 sleeve for 34 (FIG. 1*a*)
13 swivel bearing between 21, 11 (FIGS. 1*a*, 1*b*)
14 cooperating swivel bearing part on 11, bearing shell
15 shell edge of 11
16 electric component carrier (FIG. 6)
17 receptacle in 16 for 40 (FIG. 6)
18 positioning web in 17 for 40 (FIG. 6)
19 profiling on 32.3, 33.3, cutting edge (FIG. 8*b*)
20 hard component of 21
21 cover-like control rocker for 11
21' alternative control rocker (FIG. 7)
22 soft component of 21
23 handle, central area of 21 made of 20 (FIGS. 1*a* to 2)
23.1 unactuated switching position of 23 (FIG. 1*a*)
23.2 actuated switching position of 23 (FIG. 1*b*)
24 swivel bearing part of 21 made of 20, bearing block (FIG. 2)
25 peripheral edge region of 22, frame (FIG. 2)
26 central strip (FIGS. 1*a*, 2)
27 actuating striker in 26 made of 22 (FIG. 2)
27' actuating striker made of 20 (FIG. 7)
28 profile piece on 27
29 force arrow of the actuation of 21 (FIG. 1*b*)
30 combined insert (FIG. 3)
31.1 insert grid (FIGS. 2, 4)
31.2 insert grid (FIG. 8*a*)
31.3 insert grid (FIG. 8*b*)
31.4 insert grid (FIGS. 9*a*, 9*b*)
31.5 insert grid (FIG. 10)
32.1 conductor (FIG. 4)
32.2 grid rod (FIG. 8*a*)
32.3 grid rod (FIG. 8*b*)
32.4 grid rod (FIGS. 9*a*, 9*b*)
32.5 grid rod (FIG. 10)
33.1 conductor (FIG. 4)
33.2 grid rod (FIG. 8*a*)
33.3 grid rod (FIG. 8*b*)
33.4 grid rod (FIGS. 9*a*, 9*b*)
33.5 grid rod (FIG. 10)
34 rear end sections of 32.1; 32.2; 32.3; 33.3; 32.4; 33.4; 32.5; 33.5
35.1 front end section of 32.1 (FIG. 4)
35.2 front end section of 32.2 (FIG. 8*a*)
35.3 front end section of 32.3 (FIG. 8*b*)
36.1 front end section of 33.1 (FIG. 4)
36.2 front end section of 33.2 (FIG. 8*a*)
36.3 front end section of 33.3 (FIG. 8*b*)
37 support bearing for 40 in 30, base for 40 (FIG. 3)

38 clip at 37, elastically deformable element (FIG. 3)
39 opening at 38 (FIG. 3)
40 snap disk with outline of four-pointed star
41 narrowed bearing points on 40
42 convex upper side of snap disk 40
43 convex arch of 40 (FIGS. 1*a*, 4)
44 central dent in 40 (FIG. 4)
45 curved disk edge of 40 between 41 (FIG. 4)
46 concavely arched underside of 40 (FIG. 4)
47 inner section of 32.4 wound into a U-shaped structure (FIG. 9)
48 guide element for 40, web (FIG. 3)
49 cutting edge at 19 (FIG. 8*b*)
50.4 support bearing for 40 (FIG. 9*a*)
50.5 support bearing for 40 (FIG. 10)
51 winding interior of 47 (FIG. 9*a*)
52.4 tongue (FIG. 9°)
52.5 tongue (FIG. 10)
53 bending arrow for 52.4 (FIG. 9*b*)
54 gap between 52.4 (FIG. 10)
55 housing interior of 11 (FIG. 2)
57 inner section of 32.5 wound into the shape of an octagon (FIG. 10)

The invention claimed is:

1. A control (10) for the electric actuation of a lock on a hinged lid or door in a vehicle, comprising:

a control housing (11), on which a manually operated control rocker (21) is rotatable supported (13), at least two electric lines in the control housing (11), which extends from the control housing (11) and are connected to an electric actuator of the lock, an electric switch, which in its switch housing has a deformable snap disk (40) as a moving contact above at least two rest contacts, which are connected with the lines in the control housing (11), and a switch for deforming the snap disk (40), wherein the control housing (11) simultaneously forms the switch housing, and the control rocker (21) acts as the switch actuator, where the rest contacts of the switch and the lines in the control housing (11) are formed as a single piece and form an insert grid in the control housing (11), where the control housing (11) directly has a support bearing (37) for bearing points on the snap disk (40) in the area of the insert grid (31.1), where the control housing (11) has a shell-like design, and the control rocker (21) functions as a cover for this shell (11), and where the control rocker (21) has an elastomeric edge region, which is permanently connected with the shell edge (15) of the control housing (11).

2. A control in accordance with claim 1, wherein the swivel bearing (13) for the control rocker (21) is located in the vicinity of the support bearing (37) of the snap disk (40) and/or lies essentially in the longitudinal center of the control housing (11).

3. A control in accordance with claim 2, wherein the control rocker (21) has an actuating striker (27), which is arranged eccentrically to the swivel bearing (13) of the control rocker (21), where, during the manual rotation (29) of the control rocker (21), the actuating striker (27) deforms the snap disk (40) from its noncontacting rest position into a contacting operating position.

4. A control in accordance with claim 3, wherein the actuating striker (27) has a profile piece (28), which secures the snap disk (40) in its rest position in such a way that it cannot fall off the support bearing (37).

5. A control in accordance with claim 1, wherein the insert grid (31.1) has a precoating and is thus part of a combined insert (30), where the combined insert (30) is correctly positioned in the control housing (11) during the final injection molding.

6. A control in accordance with claim 5, wherein at the same time the support bearing (37) for the bearing points (41) of the snap disk (40) has the precoating of the combined insert (30).

7. A control in accordance with claim 5, wherein the combined insert (30) has a receptacle (17) for the insertion of the snap disk (40) to ensure that the snap disk (40) is properly positioned after it has been inserted.

8. A control in accordance with claim 7, wherein the receptacle has a base (37), which is bounded at least in certain places by elastic elements (38), where these elements (38) embrace the edges of the snap disk (40) after it has been put in place.

9. A control in accordance with claim 8, wherein the base (37) is bounded in certain places by guide elements 18, which guide the edges of the snap disk (40) as it is being placed onto the base (17; 37).

10. A control in accordance with claim 1, wherein the insert grid (31.2) consists of two grid rods (32.2, 33.2), which, after the control housing (11) has been produced, are inserted in well-defined locations in the housing interior (55), where the inserted front end sections (35.2, 36.2) of the grid rods (32.2, 33.2) arrive in a region of the housing that forms support bearings (37) for the bearing points (41) of the snap disk (40).

11. A control in accordance with claim 10, wherein the front end sections (35.3, 36.3) of the grid rods (32.2, 33.2) have profilings (19) that facilitate their insertion in the control housing (11).

12. A control in accordance with claim 10, wherein the profilings (19) consist of cutting edges (49).

13. A control in accordance with claim 1, wherein the grid rods (35.2, 36.2) of the insert grid (31.2) are a metal insert that is inserted in the mold before the production of the control housing (11) by injection molding.

14. A control in accordance with claim 13, wherein one of the grid rods (32.4) has a wound inner section (47), which at the same time forms the support bearings (50.4) for the bearing points (41) provided on the snap disk (40), where another grid rod (33.4) extends into the winding interior (51) of the inner section (47) and supports the snap disk (40) from below in its arched region.

15. A control in accordance with claim 14, wherein tongues (52.4) are arranged on the wound inner section (47) of the grid rod and serve to secure the position of the snap disk (40) after it has been put in place in the control housing (11).

16. A control in accordance with claim 15, wherein after the snap disk (40) has been inserted, the tongues (52.4) are bend down (53) over the bearing points (41) of the snap disk (40).

17. A control in accordance with claim 14, wherein the gaps (54) between the tongues (52.4) serve as support bearings (50.5) for the bearing points (410 of the snap disk (40), where the tongues (52.5) act in the arched region (43) of the fitted snap disk (40).

18. A control in accordance with claim 17, wherein the central area (23) of the control rocker (21), which is used for manual actuation (29), is enclosed by the elastomeric edge region (25) in the manner of a frame, where the elastomeric frame (25) is fastened on the shell edge (15) of the control housing (11) by welding, especially laser welding.

19. A control in accordance with claim 18, wherein the control rocker (21) with its elastomeric edge region (25) is produced by a so-called multicomponent injection molding technique and consists of an elastically flexible soft component (22), which is located at least in the edge region (25), and a hard component (20), which forms the central area (23) used for the manual actuation (29).

20. A control in accordance with claim 19, wherein the swivel bearing parts (24) are part of the hard component (20).

21. A control in accordance with claim 19, wherein the actuating striker (17), which is located on the underside of the control rocker (21) and deforms the snap disk (40) during manual actuation, consists of the soft component (22).

* * * * *